US008115778B2

(12) United States Patent
Schwarzer

(10) Patent No.: US 8,115,778 B2
(45) Date of Patent: Feb. 14, 2012

(54) SYSTEM AND METHOD FOR SELECTING A PIXEL OUTPUT FORMAT

(75) Inventor: Martin Schwarzer, Wuerselen (DE)

(73) Assignee: NVIDIA Corporation, Santa Clara, CA (US)

( * ) Notice: Subject to any disclaimer, the term of this patent is extended or adjusted under 35 U.S.C. 154(b) by 678 days.

(21) Appl. No.: 12/238,643

(22) Filed: Sep. 26, 2008

(65) Prior Publication Data

US 2010/0079484 A1 Apr. 1, 2010

(51) Int. Cl.
*G09G 5/00* (2006.01)

(52) U.S. Cl. ..... 345/603; 345/619; 345/605; 345/600

(58) Field of Classification Search ..... 345/619, 345/600, 603, 605
See application file for complete search history.

(56) References Cited

U.S. PATENT DOCUMENTS 5,828,383 A * 10/1998 May et al. ..... 345/546
5,940,080 A * 8/1999 Ruehle et al. ..... 345/611
6,043,804 A * 3/2000 Greene ..... 345/601
6,222,550 B1 * 4/2001 Rosman et al. ..... 345/419
2005/0184993 A1 * 8/2005 Ludwin et al. ..... 345/502
2009/0033670 A1 * 2/2009 Hochmuth et al. ..... 345/545

OTHER PUBLICATIONS

Office Action from Chinese Patent Application No. 200910176689.2 dated Jul. 8, 2011.
Notice of Preliminary Rejection from Korean Patent Application No. 10-2009-0091138 dated Feb. 11, 2011.
Notice of Allowance from Korean Patent Application No. 10-2009-0091138, Oct. 13, 2011.
Examination Report from Patent Application No. 10 2009 037 287.3, dated Dec. 2, 2011.

* cited by examiner

*Primary Examiner* — M Good Johnson
(74) *Attorney, Agent, or Firm* — Zilka-Kotab, PC

(57) ABSTRACT

A method for selecting a pixel output format includes selecting a first pixel to be output, and determining whether the first pixel to be output overlaps with a second pixel. The second pixel is available in the first format from a first source, and in a second format from a second source. The method further includes converting the second pixel in the second format to the first format to produce a converted second pixel. The converted second pixel is compared to the second pixel having the first format, and the second pixel having the first format or the second pixel having the second format is selected for output based upon the comparison.

22 Claims, 2 Drawing Sheets

SYSTEM AND METHOD FOR SELECTING A PIXEL OUTPUT FORMAT

FIELD OF THE INVENTION

The present invention relates to pixel processing, and in particular to systems and methods for selecting an output format for pixels.

BACKGROUND

A computer desktop ("desktop" for brevity) is software that controls the placement and appearance of windows within a windowing system in a graphical user interface. Most typically, images rendered by the desktop are controlled by a graphics device interface (gdi) that interfaces to an output device such as a monitor or printer. Among other things, the gdi defines the output format of pixels rendered via the desktop to a particular format, for example, a format of 8 bits per pixel RGBA.

Such an arrangement in which the gdi defines a particular pixel output format for all pixels is not optimal, as the desktop is capable of storing pixel content of differing color depths including enhanced pixel formats, which could be rendered on a monitor compatible with such formats. Unfortunately, conventional desktops do not provide the flexibility of rendering images at differing color depths, as the desktop's gdi limits the pixel output format to one particular format.

Accordingly, what is needed is system and method which enables selection of different pixel output formats.

SUMMARY

A system and method for selecting a pixel output format is provided. The method includes selecting a first pixel to be output, and determining whether the first pixel overlaps with a second pixel. The second pixel is available in the first format from a first pixel source, and in a second format from a second pixel source. The method further includes converting the second pixel having the second format to the first format to produce a converted second pixel. The converted second pixel is compared to the second pixel having the first format, and the second pixel having the first format or the second pixel having the second format is selected for output based upon the comparison.

These and other aspects of the invention will be better understood in view of the following drawings and detailed description of exemplary embodiments.

DETAILED DESCRIPTION OF EXEMPLARY EMBODIMENTS

Figure 1:
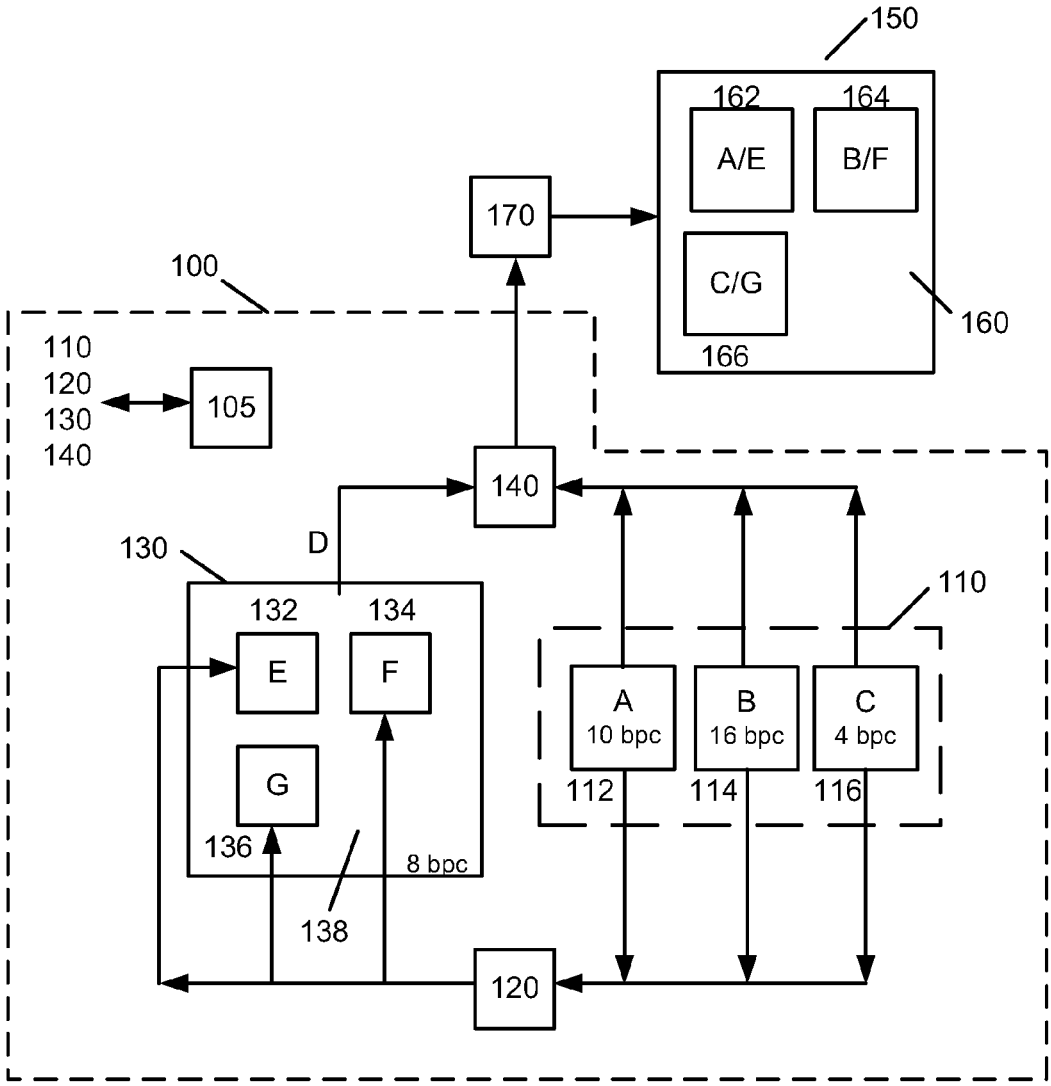
FIG. 1 illustrates an exemplary system for selecting a pixel output format in accordance with the present invention.

FIG. 1 illustrates an exemplary system 100 for selecting a pixel output format in accordance with the present invention. The system 100 includes a processing unit 105, one or more pixel sources 110, a format convertor 120, a desktop 130, and a pixel selector 140. The system cooperates with an output device, e.g., a monitor 150 on which is displayed a monitor desktop 160. Optionally, a second format converter 170 is coupled between the system 100 and the monitor 150 for providing an additional pixel format conversion.

Processing unit 105 is operable to execute instructions for performing operations as described herein. Pixel sources 110 include one or more (three shown) pixel sources 112, 114, and 116, each operable to store pixel content in respective different pixel formats. For example, pixel source 112 stores pixel content A in a 10 bit per color (10 bpc) format, pixel source 114 stores pixel content B in a 16 bpc format, and pixel source 116 stores pixel content C in a 4 bpc format. Any particular color space format can be implemented, for example RGB, RGBA, YcrCb, or HSL/HSV, in floating point or integer representations, as well as in mixed or even component sizes. The format and content of pixels stored in each of pixel sources 112, 114 and 116 are identified as A, B, and C, respectively.

Further particularly, the pixel sources 112, 114, and 116 are embedded within the desktop 130, although their native pixel formats are not compliant with the desktop pixel format. For example, the desktop 130 may have a pixel format of 8 bpc. In such an instance, pixels from the embedded pixel sources 112, 114, and 116 will not be rendered in their native formats. Nevertheless, the location of pixels in each of these embedded sources is known to the operating system.

Format convertor 120 is operable to receive pixels from pixel sources 112, 114 and 116 which will be visible on the desktop 130, and convert the native format of these pixels into a format which is compatible with the desktop 130. Continuing with the exemplary embodiment in which the desktop 130 is compatible with an 8 bpc format, format convertor 120 operates to reduce the format of the 10 bpc pixels from source 112 (i.e., decreasing the color depth) to an 8 bpc format. The converted pixels are subsequently stored in a corresponding desktop pixel source 132 which stores content E in a pixel format (8 bpc) different from that of pixel source 112 (10 bpc). Similarly, format convertor operates to convert pixel content B from a 16 bpc format to a 8 bpc format, storing the converted pixels into desktop pixel source 134 (pixel content and format F). Pixel source 116 stores pixel content C at a format of 4 bpc, which is lower than the desktop format of 8 bpc. In such an instance, the format convertor 120 operates to expand the format of the pixels from source 116 (i.e., increasing the color depth) into an 8 bpc format, and these converted pixels are stored into desktop pixel source 136 (pixel content and format G). Conversion of the pixel formats may be performed in a variety of ways. For example, a reduction in the pixel formats may be carried out by truncating the least significant bit of the color space value, dithering, or other techniques. Expanding the format of pixels supplied from pixel source 116 may be carried out by shifting up all color bits by 4 places or by using a predefined lookup table. The desktop 130 may include pixels 138 which are not included within any of the pixel sources 132, 134 and 136. However, pixels read out from the desktop 130 will be in the same format, for example, 8 bpc. Collectively, the pixels read out from the desktop 130 are referred as pixels D, as shown.

The desktop 130 includes the desktop pixel sources 132, 134 and 136, which in a particular embodiment are open windows in the Windows XP or VISTA operating system environment. Each of the desktop pixel sources 132, 134 and 136 will have a pixel format which is governed by a gdi of the desktop 130, for example, an 8 bpc format in the illustrated embodiment. The desktop 130 may employ any gdi, for example, Windows® GDI, GDI+, Apple® QuickDraw, or DirectX graphics device interfaces, each operable to provide interactions 131 between the desktop 130 and the desktop's operating system.

In an exemplary embodiment, format conversion of pixels is performed when content A, B, and C are embedded in the desktop 130, thereby providing corresponding desktop pixel content E, F and G. Further exemplary, pixel content A, B and C is only changed when this content is updated from applications providing this content, and not from desktop activity. Accordingly, when the desktop pixel content E, F and G have not been changed by the gdi, pixel content A will be the same as pixel content E, and similarly for pixel content B and F, and C and G. When there is a change in desktop pixel content, e.g., when the gdi touches a desktop pixel E, F, or G, the desktop pixel content E, F and G may differ from the embedded pixel content A, B, and C. A particular example of how the present invention operates in this situation is further described below.

The pixel selector 140 is coupled to receive pixels from the desktop 130 and from each of the pixel sources 112, 114 and 116. Pixels output from the desktop will be in the format defined by the desktop 130, e.g., 8 bpc in the illustrated embodiment. Each of pixel sources 112, 114 and 116 will be output to the pixel selector 140 in that source's native format, e.g., 10 bpc, 16 bpc and 4 bpc in the illustrated embodiment.

Functionality of the pixel selector 140 may be included within a shader, or alternatively implemented in hardware. Further particularly, the particular format conversion employed by convertor 120 is known to the pixel selector 140. Because of this, gdi interactions such as screenshot readbacks, menu fading, or sw cursors can be performed by the graphics device interface in a standard way.

Pixel selector 140 is operable to select which pixel from among pixels A, B, C, or D (including pixels E, F, or G) to output, using processes further described below. The pixel selector 140 outputs the selected pixels in one of the formats supplied to it, e.g., content A at 10 bpc, content B at 16 bpc, content C at 4 bpc, and content D (including pixels E, F and G) at 8 bpc. If the monitor 150 or other output device is not compatible with the format of the content output from the pixel selector 140, an optional second format convertor 170 may be implemented to convert the selected pixel into a format which is compatible with the output device/monitor 150. The selected pixels are subsequently displayed in corresponding windows 162, 164, and 166 of the monitor's desktop 160. For example, monitor window 162, operates to display either pixel content A or E, in accordance with the operations described below. Similarly, monitor windows 164 and 166 operate to display pixel content B or F, and C or G, respectively.

Figure 2:
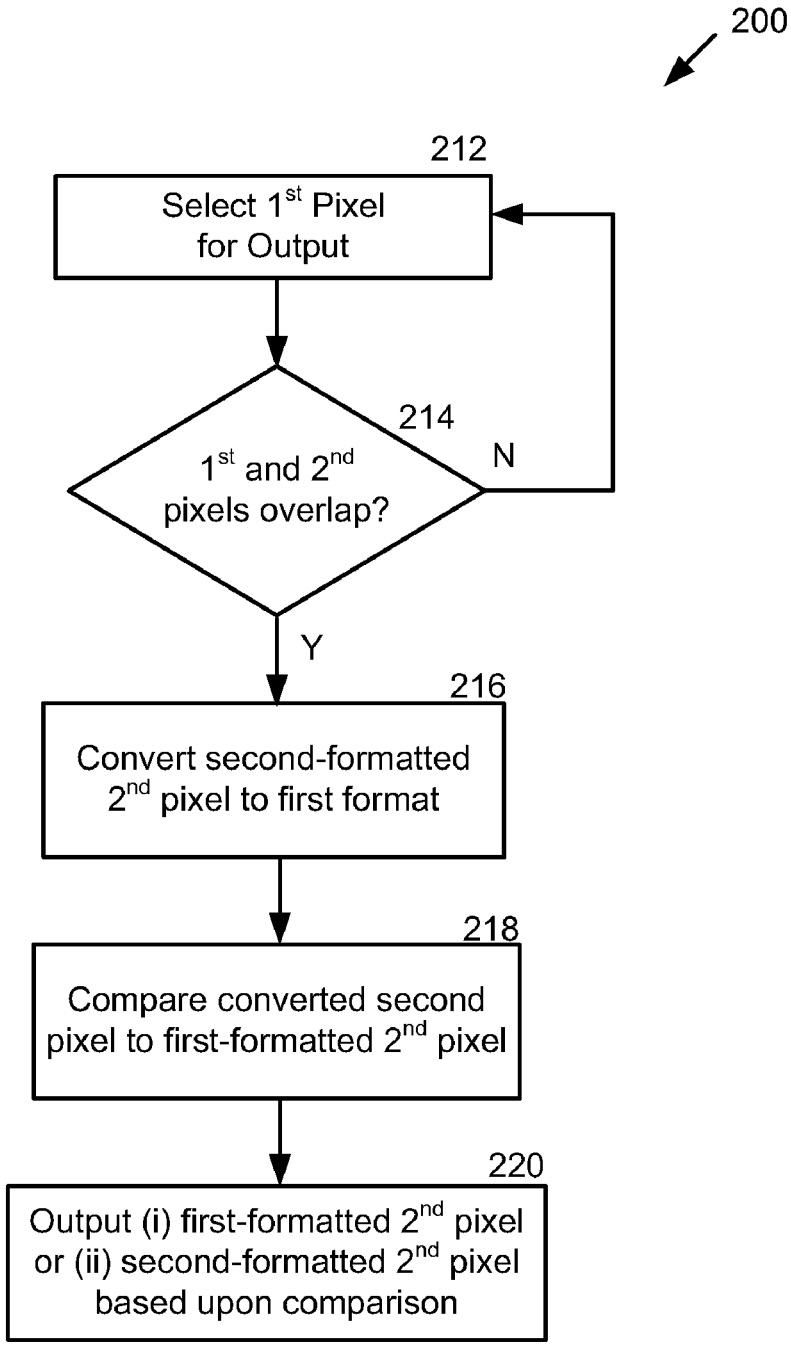
FIG. 2 illustrates an exemplary method for selecting a pixel output format in accordance with the present invention.

FIG. 2 illustrates an exemplary method for selecting a pixel output format in accordance with the present invention. At operation 212, a first pixel is selected for output. At 214, a determination is made as to whether the first pixel overlaps with a second pixel, the second pixel being available in the first pixel format from a first pixel source, and in a second pixel format from a second pixel source, the second pixel format being different from the first pixel format. If the condition is not met, the first pixel is output, and the method returns to operation 212 where another pixel is selected.

If the determination at 214 is true, the method continues at 216, wherein the second pixel available in the second format is retrieved from the second pixel source, and converted from its native format to the first pixel format, thereby producing a converted second pixel. At 218, the second pixel in the first format is retrieved from its corresponding first pixel source and compared to the converted second pixel. At 220, either the second pixel in first format (from the first pixel source) or the second pixel in the second format (from the second pixel source) is selected for output based upon the results of the comparison in 218.

Following the illustrated embodiment of FIG. 1, the first pixel is a desktop pixel D of pixel format 8 bpc which is selected for output. The pixel may be selected to be output to any device, such as a frame buffer, a monitor, or a printer.

Each of the desktop pixel sources 132, 134 and 136 storing pixel content E, F and G at 8 bpc, respectively, represents an exemplary embodiment of a second pixel source storing the second pixel at the first pixel format. Correspondingly, each of the embedded pixel sources 112, 114, and 116 storing pixel content A, B and C at pixel formats 10 bpc, 16 bpc, and 4 bpc, represents an exemplary embodiment of a second pixel source storing the second pixel at a second pixel format different from the first pixel format.

In an exemplary embodiment of operation 214, processing unit 105 operates to determine if a selected desktop pixel D overlaps with a pixel included within one of the embedded or desktop pixel sources 112/132, 114/134, or 116/136, respectively. Further specifically, an overlap condition between the first and second pixels can be determined using techniques such as a mapping table which provides information how E, F and G are positioned on the desktop, so if the areas of E, F or G are touched, operation 200 could act on these areas. It is to be noted that for a particular pixel, each of the embedded and desktop pixel sources store the same pixel location information, and as such either of the desktop or embedded pixel sources can be queried to determine if an overlap condition exists. If an overlap condition is determined not to exist, the desktop pixel D is selected for output, and the next desktop pixel is selected for processing.

If an overlap condition is determined to exist, the method continues at 216, where the second-formatted version of the overlapped pixel (i.e., pixels A, B or C) is retrieved from its embedded pixel source 112, 114, or 116 and converted from its native second pixel format to the first format (i.e., the desktop pixel format) by the format convertor 120. This pixel is referred to as a converted second pixel.

In one embodiment, the second pixel format is higher than the first pixel format (e.g., in the case of pixel sources 112 and 114), and in such an instance, operation 216 of converting the second pixel into the first pixel format include the operation of reducing the second pixel format to that of the first pixel format. Such an operation can be performed by truncating the least significant bit of the second pixel format, by dithering, or by similar such techniques. In another embodiment the second pixel format is lower than that of the first pixel format (e.g., in the case of pixel source 116), and in such an instance operation 216 of converting the second pixel into the first pixel format includes the operation of expanding the second pixel format to that of the first pixel format. Such an operation can be performed by out by shifting up all color bits by 4 places or by using a predefined lookup table.

In an exemplary embodiment of operation 218, the processing unit 105 operates to compare the color space value of the converted second pixel to color space value of the second pixel in the first format (i.e., pixels E, F, and G) stored in the first pixel source (i.e., pixel sources 132, 134 and 136). Other comparison processes may be performed as well.

In an exemplary embodiment of operation 220, the processing unit 105 operates to determine whether there is a match between the color space value of the converted second pixel and the color space value of second pixel in the first format. For example, the color space value of a format-converted version of pixel A is compared to pixel E. If the color space values of the format-converted version of pixel A and pixel E match, the gdi has not changed the color space value of the desktop pixel E, and the second pixel having the second pixel format (i.e. native pixel A) is selected for output. If the color space values of the pixels do not match, the second pixel having the first pixel format (i.e., pixel E) is selected for output from the desktop 130.

In the exemplary embodiment described herein, selection of the second pixel in the second pixel format is performed when no changes have been made to the first pixel. In such a case, selection of the second pixel in the second format is "preferred," as it provides one or more advantages over the first pixel format. In instances in which the embedded pixel sources provides an expanded pixel format compared to the first pixel format, (e.g., for embedded pixel sources 112 and 114), selection of pixels from these sources results in a wider range of colors or a greater color depth. In the instance in which the embedded pixel source provides a reduced pixel format compared to the first pixel format (e.g., pixel source 116), selection of pixels from this source may be advantageous when the reduced pixel source provides colors which are not available in the first pixel format, for example, if the reduced pixel source is capable of providing pixels in other color spaces. Those skilled in the art will appreciate that the comparison process may be formulated in different ways to provide a preferred selection of the pixel output format under different conditions.

Optional operations of method 200 include format converting the pixel format of the selected pixel to a third pixel format. For example, if pixel B is selected for output, and the output device (e.g., a monitor) is only compatible with a 10 bpc color space format, the method 200 may further include the operation of converting the format of the B pixel from a 16 bpc format to a 10 bpc format. Format converter 170 may be employed to perform this operation.

In a particular application of the invention, the gdi may touch a desktop pixel which overlaps with a pixel A/E, B/F, C/G, thereby initiating the operations of 216, 218 and 220. Such an action may generate a soft shadow or popup menu within the desktop 130. In such an instance, the overlapping desktop pixel E, F, G will include a shader contribution which is not included in corresponding embedded pixel A, B, C, and in such a case, the comparison at operation 218 will determine that the color space values of the overlapping desktop and embedded pixels do not match. In such an instance the overlapping desktop pixel E, F, or G will be selected for output. In conventional systems, removal of the soft shadow was performed by replacing the shadowed pixel with a previously read-out pixel. Performing this operation in the present method will result in the shadow being removed, and the comparison operation at 218 will result in a color space match between the desktop and embedded pixels. The embedded pixel will accordingly be selected for output. Thus, an intermediate gdi operation with no redraw command to the application will not destroy the originally scanned out color depth.

In accordance with the foregoing, it is possible to embed enhanced content with more color components or more bits per color into a desktop/window manager than the desktop is natively able to render. Additionally, gdi assess to the content is controlled, whereby access to the enhanced content is smooth and transparent to the user. The invention further permits the possibility of scanning out the embedded content to a monitor capable of rendering the enhanced color depth of the content. For example, it is possible to scanout 10 bpc RGB content from an 8 bpc RGB desktop to a monitor which could render 10 bpc pixels.

As readily appreciated by those skilled in the art, the described processes and operations may be implemented in hardware, software, firmware or a combination of these implementations as appropriate. In addition, some or all of the described processes and operations may be implemented as computer readable instruction code resident on a computer readable medium, the instruction code operable to control a computer of other such programmable device to carry out the intended functions. The computer readable medium on which the instruction code resides may take various forms, for example, a removable disk, volatile or non-volatile memory, etc., or a carrier signal which has been impressed with a modulating signal, the modulating signal corresponding to instructions for carrying out the described operations.

In a particular embodiment of the invention, a memory is operable to store instructions for performing any of the operations described in FIGS. 1 and 2. The memory may take various forms, e.g., a removable disk, an embedded memory, etc., in volatile or non-volatile form, and may be included within a variety of different systems, e.g. a computer system, an embedded processor, a graphics processor, or graphics processing sub-system, such as a graphics card.

The terms "a" or "an" are used to refer to one, or more than one feature described thereby. Furthermore, the term "coupled" or "connected" refers to features which are in communication with each other, either directly, or via one or more intervening structures or substances. The sequence of operations and actions referred to in method flowcharts are exemplary, and the operations and actions may be conducted in a different sequence, as well as two or more of the operations and actions conducted concurrently. Reference indicia (if any) included in the claims serves to refer to one exemplary embodiment of a claimed feature, and the claimed feature is not limited to the particular embodiment referred to by the reference indicia. The scope of the claimed feature shall be that defined by the claim wording as if the reference indicia were absent therefrom. All publications, patents, and other documents referred to herein are incorporated by reference in their entirety. To the extent of any inconsistent usage between any such incorporated document and this document, usage in this document shall control.

The foregoing exemplary embodiments of the invention have been described in sufficient detail to enable one skilled in the art to practice the invention, and it is to be understood that the embodiments may be combined. The described embodiments were chosen in order to best explain the principles of the invention and its practical application to thereby enable others skilled in the art to best utilize the invention in various embodiments and with various modifications as are suited to the particular use contemplated. It is intended that the scope of the invention be defined solely by the claims appended hereto.

What is claimed is:

1. A method for selecting a pixel output format, the method comprising:

selecting a first pixel to be output, the first pixel having a first format;

determining whether the first pixel overlaps with a second pixel, wherein the second pixel is available in the first format from a first source, and in a second format from a second source;

if the first pixel overlaps with the second pixel, converting the second pixel in the second format to the first format to produce a converted second pixel;

comparing the converted second pixel to the second pixel having the first format; and selecting, for output to an output device, the second pixel having the first format from the first pixel source, or the second pixel having the second format from the second pixel source based upon the comparison.

2. The method of claim 1, wherein determining whether the first pixel overlaps with the second pixel is performed using a mapping table that provides information as to how the first pixel and the second pixel are positioned.

3. The method of claim 1, wherein the first pixel format comprises a reduced pixel format compared to the second pixel format, and wherein converting the second pixel comprises reducing the second pixel format to the first pixel format to produce a converted second pixel having the first pixel format.

4. The method of claim 3, wherein reducing the second pixel format to the first pixel format includes truncating a least significant bit of the second pixel format.

5. The method of claim 1, wherein the first pixel format comprises an expanded pixel format compared to the second pixel format, and wherein converting the second pixel comprises expanding the pixel format of the second pixel to the first pixel format to produce a converted second pixel having the first pixel format.

6. The method of claim 1, wherein the second pixel having the first format comprises a first color space value, and the converted second pixel comprises a second color space value, wherein comparing comprises comparing the first and second color space values, and wherein selecting comprises selecting the second pixel having the second format for output to an output device if the first and second color space values match.

7. The method of claim 1, wherein the second pixel having the first format comprises a first color space value, and the converted second pixel comprises a second color space value, wherein comparing comprises comparing the first and second color space values, and wherein selecting comprises selecting the second pixel having the first for format for output if the first and second color space values do not match.

8. The method of claim 1, further comprising format converting the pixel format of the selected pixel to a third pixel format.

9. The method of claim 8, further comprising outputting the selected pixel in the third pixel format to an output device.

10. A system operable to select a pixel output format, the system comprising:

processing unit circuitry operable to determine whether the first pixel to be output overlaps with a second pixel, wherein the second pixel is available in the first format from a first source, and in a second format from a second source;

a format convertor operable to convert the second pixel in the second format to the first format to produce a converted second pixel;

processing unit circuitry operable to compare the converted second pixel to the second pixel having the first format; and a format selector operable to select for output to an output device, the second pixel having the first format from the first pixel source, or the second pixel having the second format from the second pixel source based upon the comparison performed by the processing unit circuitry.

11. The system of claim 10, wherein the first pixel format comprises a reduced pixel format compared to the second pixel format, and wherein the format convertor is operable to reduce the second pixel format to the first pixel format to produce a converted second pixel having the first pixel format.

12. The system of claim 10, wherein the first pixel format comprises an expanded pixel format compared to the second pixel format, and wherein the format convertor is operable to expand the pixel format of the second pixel to the first pixel format to produce a converted second pixel having the first pixel format.

13. The system of claim 10, wherein the second pixel having the first format comprises a first color space value, and the converted second pixel comprises a second color space value, wherein the processing unit circuitry is operable to compare the first and second color space values, and wherein the pixel selector is operable to select the second pixel having the second format for output to an output device if the first and second color space values match.

14. The system of claim 10, wherein the second pixel having the first format comprises a first color space value, and the converted second pixel comprises a second color space value, wherein the processing unit circuitry is operable to compare the first and second color space values, and wherein the pixel selector is operable to select the second pixel having the first format for output if the first and second color space values do not match.

15. The system of claim 10, further comprising a second format converter operable to convert the pixel format of the selected pixel to a third pixel format.

16. The system of claim 15, further comprising means for outputting the selected pixel in the third pixel format to an output device.

17. A computer program product, resident on a non-transitory computer readable medium, operable for executing instructions for selecting the format of a pixel which is to be output, the computer program product comprising instruction code to:

select a first pixel to be output, the first pixel having a first format;

determine whether the first pixel to be output overlaps with a second pixel, wherein the second pixel is available in the first format from a first source, and in a second format from a second source;

convert the second pixel in the second format to the first format to produce a converted second pixel if the first pixel overlaps with the second pixel;

compare the converted second pixel to the second pixel having the first format; and select, for output to an output device, the second pixel having the first format from the first pixel source, or the second pixel having the second format from the second pixel source based upon the comparison.

18. The computer program product of claim 17, wherein the first pixel format comprises a reduced pixel format compared to the second pixel format, and wherein the instruction code to convert the second pixel comprises instruction code to reduce the second pixel format to the first pixel format to produce a converted second pixel having the first pixel format.

19. The computer program product of claim 17, wherein the first pixel format comprises an expanded pixel format compared to the second pixel format, and wherein the instruction code to convert the second pixel comprises instruction code to expand the pixel format of the second pixel to the first pixel format to produce a converted second pixel having the first pixel format.

20. The computer program product of claim 17, wherein the second pixel having the first format comprises a first color space value, and the converted second pixel comprises a second color space value, wherein the instruction code to compare comprises instruction code to compare the first and second color space values, and wherein the instruction code to select comprises instruction code to select the second pixel having the second format for output to an output device if the first and second color space values match.

21. The computer program product of claim 17, wherein the second pixel having the first format comprises a first color space value, and the converted second pixel comprises a second color space value, wherein the instruction code to compare comprises instruction code to compare the first and second color space values, and wherein the instruction code to select comprises instruction code to select the second pixel having the first format for output if the first and second color space values do not match.

22. The computer program product of claim 17, further comprising instruction code to format convert the pixel format of the selected pixel to a third pixel format.

* * * * *

UNITED STATES PATENT AND TRADEMARK OFFICE

CERTIFICATE OF CORRECTION

PATENT NO. : 8,115,778 B2
APPLICATION NO. : 12/238643
DATED : February 14, 2012
INVENTOR(S) : Martin Schwarzer It is certified that error appears in the above-identified patent and that said Letters Patent is hereby corrected as shown below:

Claim 7, col. 7, line 34; replace "first for format" with --first format--.

Signed and Sealed this
Fifth Day of March, 2013

Teresa Stanek Rea
*Acting Director of the United States Patent and Trademark Office*